US006536327B2

(12) United States Patent
Zona

(10) Patent No.: US 6,536,327 B2
(45) Date of Patent: Mar. 25, 2003

(54) DOUBLE ACTING CYLINDER WITH INTEGRAL END POSITION VOLUME CHAMBERS

(75) Inventor: Michael Zona, Melville, NY (US)

(73) Assignee: Festo Corporation, Hauppauge, NY (US)

( * ) Notice: Subject to any disclaimer, the term of this patent is extended or adjusted under 35 U.S.C. 154(b) by 0 days.

(21) Appl. No.: 09/878,086

(22) Filed: Jun. 8, 2001

(65) Prior Publication Data

US 2002/0184997 A1 Dec. 12, 2002

(51) Int. Cl.[7] ..... F15B 15/22
(52) U.S. Cl. ..... 91/394; 92/85 B
(58) Field of Search ..... 92/85 B; 91/394, 91/396

(56) References Cited

U.S. PATENT DOCUMENTS 2,719,510 A * 10/1955 Elder ..... 93/396 X
2,935,047 A * 5/1960 Ortman et al. ..... 91/396
3,267,815 A * 8/1966 Ortman et al. ..... 91/396 X
3,805,672 A * 4/1974 Pekrul ..... 91/396 X
4,458,717 A * 7/1984 Boland ..... 91/396 X
4,807,514 A * 2/1989 Gartzmuller ..... 91/396 X
4,862,786 A * 9/1989 Boyer et al. ..... 91/396 X
5,207,145 A * 5/1993 Kemner ..... 92/85 B X

* cited by examiner

*Primary Examiner*—Edward K. Look
*Assistant Examiner*—Thomas E. Lazo
(74) *Attorney, Agent, or Firm*—Hoffmann & Baron, LLP

(57) ABSTRACT

A pneumatic cylinder having a cylinder tube with at least one open end coupled to an end cap to close the open end. The pneumatic cylinder includes a piston reciprocally movable in the cylinder and the piston has a first seal to create a substantially fluid-tight seal with the internal surface of the cylinder tube. The piston has a piston spear at the end portion thereof for cooperating with a piston spear receiving space in the end cap. A second seal is provided in the piston spear receiving space for creating a substantially fluid-tight seal between the piston spear and the piston spear receiving space thereby creating a volume chamber between the first and second seals. The volume chamber provides a compressible volume of volume which acts as an air cushion at the end of the piston stroke.

13 Claims, 4 Drawing Sheets

DOUBLE ACTING CYLINDER WITH INTEGRAL END POSITION VOLUME CHAMBERS

BACKGROUND OF THE INVENTION

1. Field of the Invention

The present invention relates generally to an end position cushioning system for a double acting pneumatic cylinder and more particularly to a cushioning system using a volume chamber of air to provide reduced noise cushioning.

2. Brief Description of the Prior Art

A double acting cylinder typically includes a piston that reciprocates inside a cylinder tube. The piston is generally coupled to a slide or follower that moves in conjunction with the piston. The piston is reciprocally moved pneumatically in the cylinder by injecting a fluid, usually air, into the ends of the cylinder. The movement of the piston can be stopped by can be use a number of different methods such as a bumpers or air cushions as discussed below.

When the piston comes into contact with the end cap it is possible that the end cap or piston may be damaged by the piston engaging the end cap. In addition, when the piston hits the end cap there is the possibility that the follower attached to the piston may stop abruptly. Thus, the movement of the follower in such situations is not very accurate and may transfer unwanted vibration to the object attached to the follower. Furthermore, when the piston contacts the end cap, a loud noise may be created since the piston and the end cap are usually made of rigid materials. Currently there exist several cushioning methods to address the problem of providing cushioning between the piston and the end cap so that the piston will not contact the end cap and make noise.

The first type of cushioning is a fixed bumper system 40 as shown in FIG. 2. In the fixed bumper system, the surface of the end cap 42 that contacts the piston 44 includes a cushion 46 in the form of a shock absorbent material. This shock absorbent material may be a spongy or rubber type material so that when the piston 44 comes into contact with the end cap 42, the fixed bumper 46 will cushion the impact of the piston 44 hitting the end cap 42. The shock absorbing material brings the piston to a halt and decreases the amount of noise that is produced when the piston reaches the end of its stroke. The fixed bumpers are commonly made from a synthetic rubber such as polyurethane or neoprene since they are both durable and provide good shock absorption. In addition, these materials are relatively cheap and not only help relieve the impact forces but also reduce the amount of noise that is produced when the piston hits the end cap.

However, the disadvantage to using the fixed bumper is that over time the shock absorbing material will wear out from the constant use of the piston crushing the bumper. Another disadvantage to the fixed bumper cushioning system is that since the fixed bumpers are inherently a spongy type material, the compression rate of the material may change over time as it is compressed. Thus, the stroke distance that the piston will travel will vary slightly due to the changing compression rate of the fixed bumper as it is used.

A second type of cushioning system is an adjustable air cushioning system as shown in FIGS. 3 and 4. In the adjustable air cushioning system 50, a piston spear extends outwardly from the piston body and engages a volume chamber within the end cap. In the adjustable air cushion 50, as the piston 52 approaches the end cap 54 the air in the volume chamber between the piston spear and the end cap is compressed and released via a small orifice 58 in the end cap 54. In addition, a needle valve 56 is inserted within the path of the exhaust to further regulate the rate at which the trapped air evacuates (FIG. 4). More specifically, the needle valve may be adjusted to control the rate at which the air is released thereby regulating the end of the piston stroke. Thus, the piston can be brought to a stop without contacting the end cap by slowly letting air evacuate the volume chamber through the needle valve. An advantage of this cushioning method is that the impact stresses are reduced and cushioning is more efficiently achieved when compared to fixed bumpers. This method of cushioning is also more expensive than the fixed bumper since an additional component is required, i.e., a needle valve. Furthermore, should the needle valve fail to operate, the piston will contact the end cap possibly causing severe damage to the device. Like fixed bumpers, the accuracy of the piston movement may be variable due to the changing compression properties of the air used in the cushioning system.

Still a further known type of cushioning system is not to use a cushioning system at all between the piston and the end cap, but rather use an external shock absorbing system. This system may take the form of small shock absorbers which use dampers or simple rubber shock absorbers attached to the follower housing. The disadvantage of this system is that there is still a significant amount of noise produced and the external cushion or external shock absorbers are expensive and require continued maintenance.

It would be desirable to create a cushioning system that overcomes the disadvantages of current systems such as high impact forces created by the piston coming into contact with the end cap. It would also be desirable to create a cushioning system that reduces or completely eliminates the noise produced by the piston coming into contact with the end cap or the slide contacting an external shock absorber.

It would also be advantageous to create a cushioning system that completely eliminates the piston from coming into contact with the end cap thereby greatly reducing the amount of wear and noise generated by the piston reaching the end of its stroke.

OBJECTS AND SUMMARY OF THE INVENTION

It is an object of the present invention to provide a cushioning system that relieves the impact forces associated with a double acting cylinder piston reaching the end of its stroke.

It is another object of the present invention to provide a cushioning system that greatly reduces or eliminates the noise produced by the double acting cylinder piston reaching the end of its stroke.

It is still a further object of the present invention to provide a cushioning system including a secondary cushioning system should the primary cushioning means should fail.

In one form of the present invention a pneumatic cylinder having a cylinder tube with at least one open end may be coupled to an end cap to close the open end. The pneumatic cylinder may have a piston that is reciprocally movable in the cylinder. The piston has a first seal to create a substantially fluid-tight seal with the internal surface of the cylinder tube. In the preferred embodiment the piston has a piston spear at the end portion of the piston for cooperating with a piston spear receiving space in the end cap. Preferably, there is a second seal in the piston spear receiving space so that when the piston spear contacts the second seal a substantially fluid-tight seal between the piston spear and the second seal in the piston spear receiving space is created, thereby creating a volume chamber between the first seal and the second seal which is used as an air cushion at the end of the piston stroke to prevent the piston from contacting the end cap.

In a more preferred embodiment of the present invention it is envisioned that there is at least one elastomeric cushioning device positioned adjacent to the end surface of the end cap to provide a secondary cushion between the piston and the end cap. Preferably, this secondary cushioning may be made of neoprene and polyurethane. The advantage of the secondary cushion is that should the first or second seal which creates the volume chamber leak or fail, the piston would not contact the end cap. Instead, the piston would come in contact with the elastomeric cushioning device so that the piston would be safely stopped and not damage either the end cap or the piston.

Further objects and features of the present invention will better be understood in light of the embodiment examples which are discussed below with the aid of the accompanying drawing.

DETAILED DESCRIPTION OF THE PREFERRED EMBODIMENTS

Figure 1:
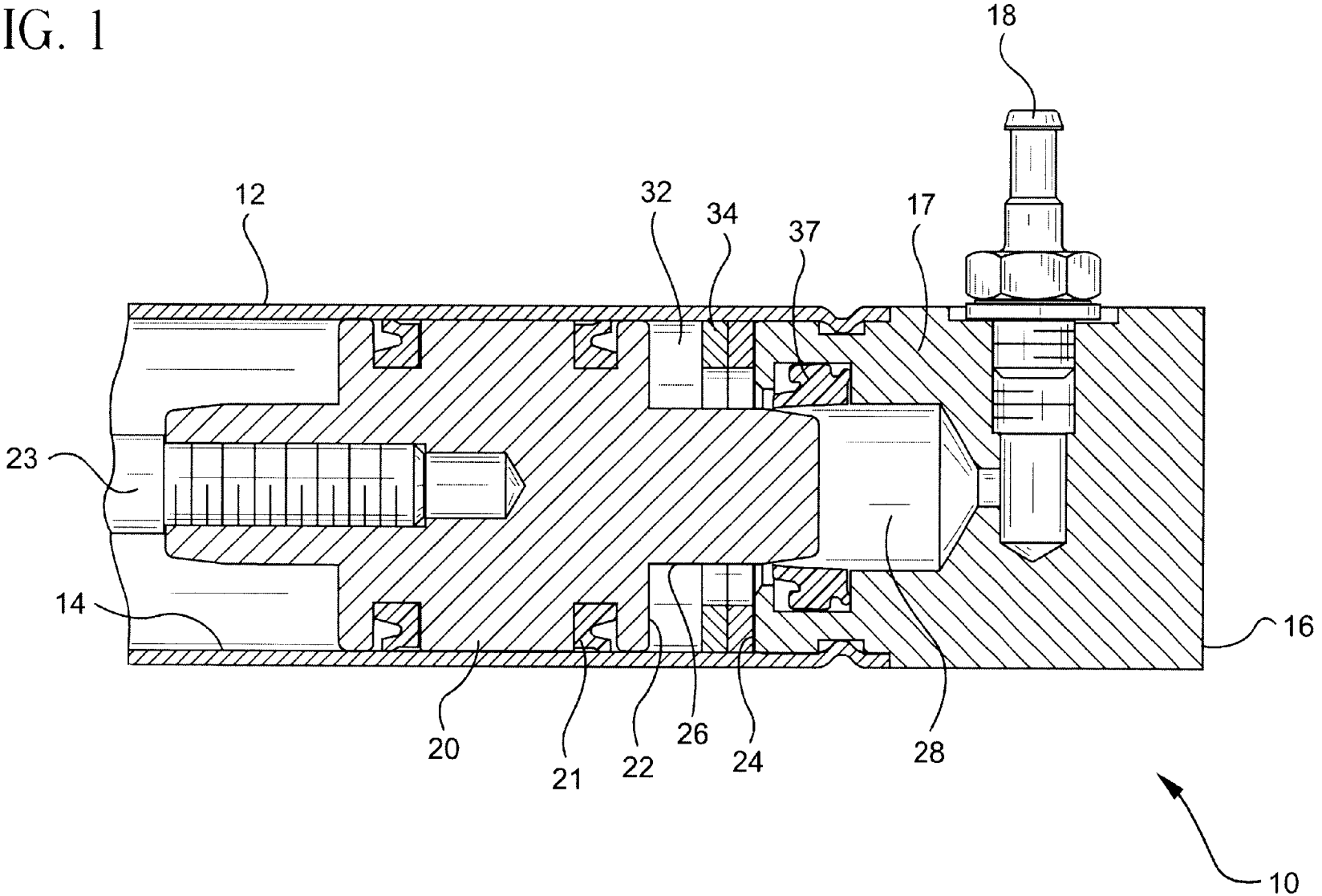
FIG. 1 is a side cross-sectional view of a double acting cylinder illustrating the piston and end cap configuration of the present invention.
Figure 2:
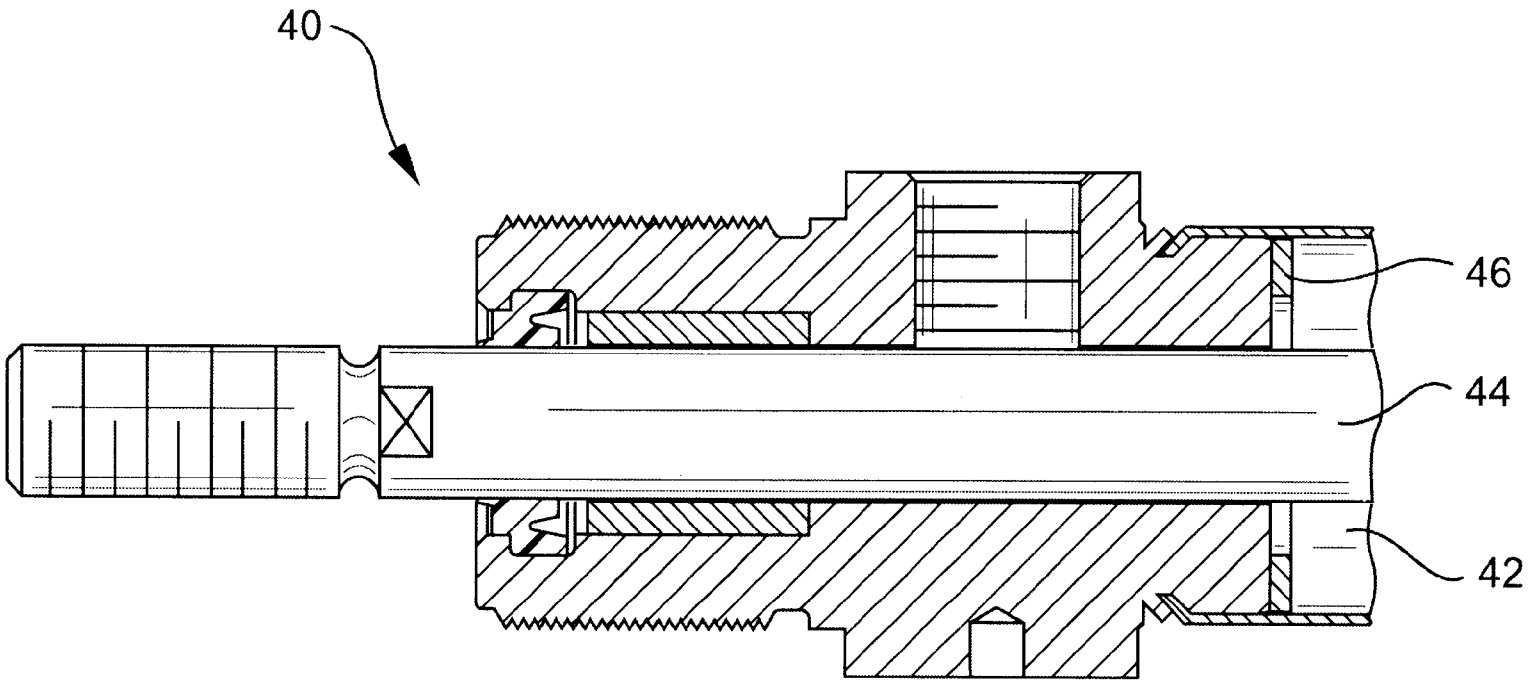
FIG. 2 PRIOR ART
FIG. 2 is a side cross-sectional view of a prior art double acting cylinder using fixed bumpers.
Figure 3:
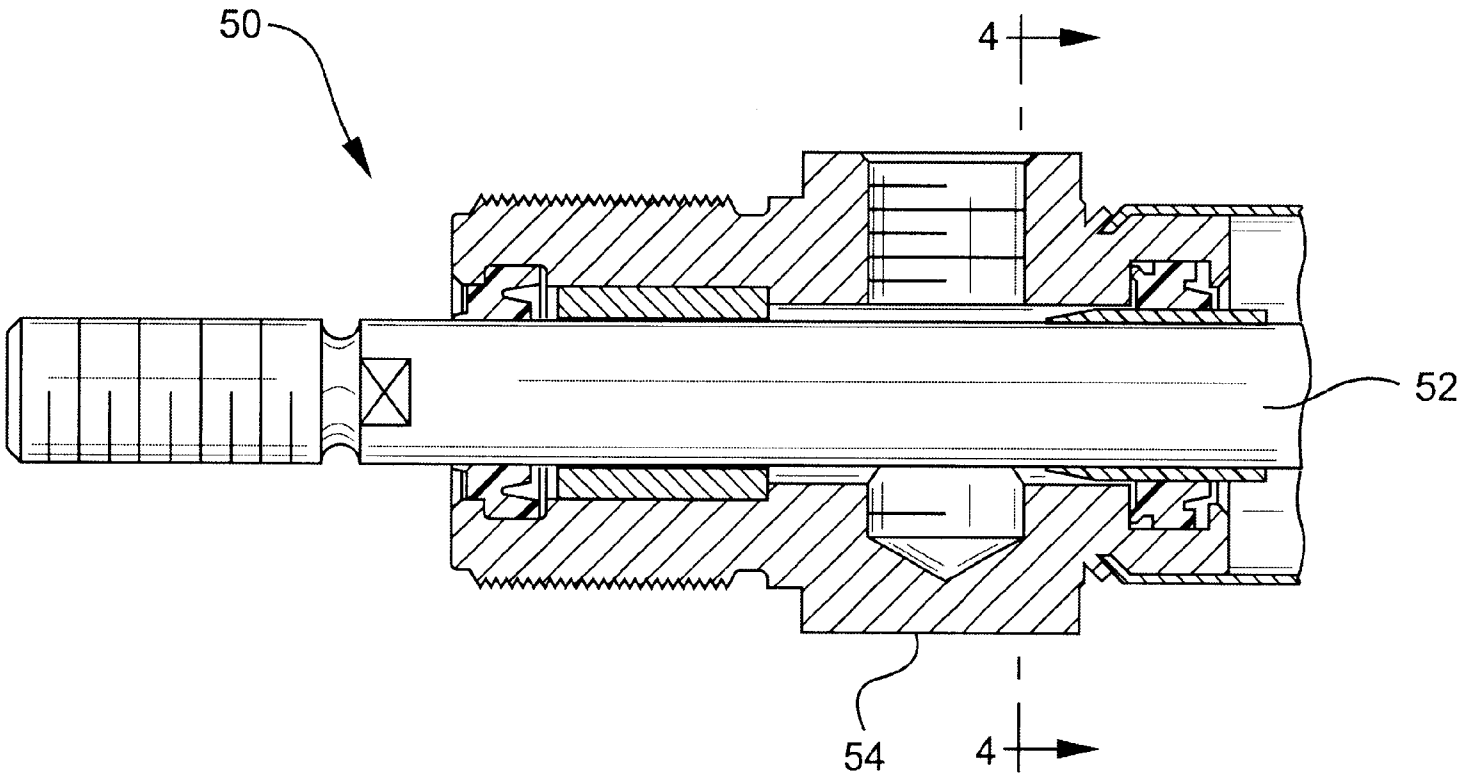
FIG. 3 PRIOR ART
FIG. 3 is a side cross-sectional view of a prior art double acting cylinder using a needle valve.
Figure 4:
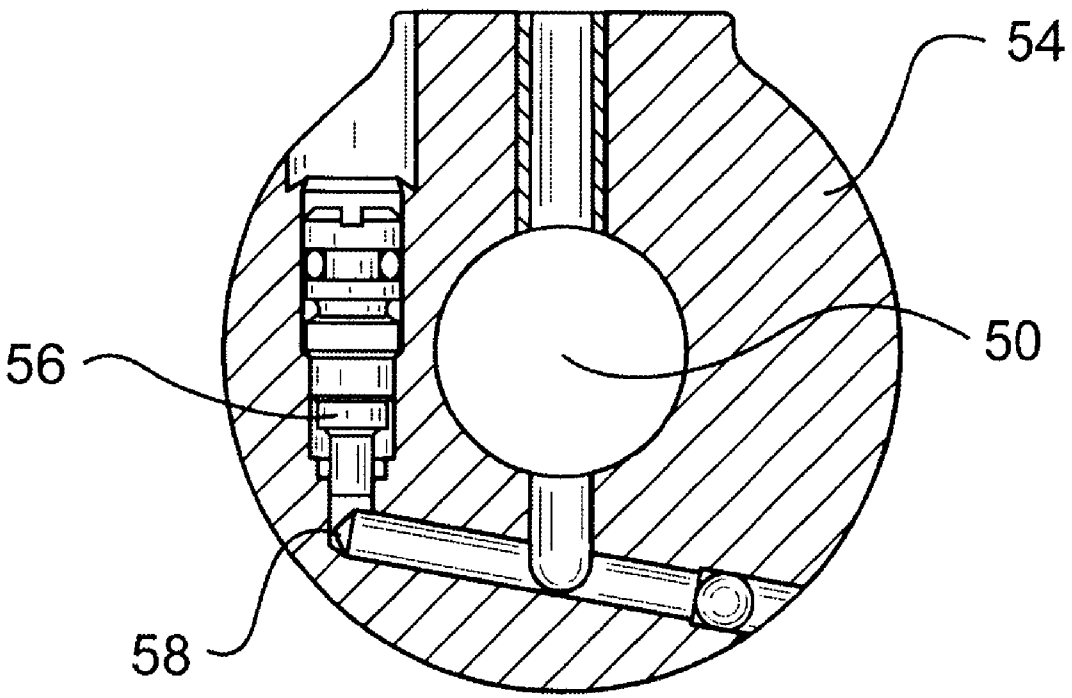
FIG. 4 PRIOR ART
FIG. 4 is a cross-sectional view of a prior art double acting cylinder using a needle valve taken along line 4—4 of FIG. 3.

Referring to FIG. 1, a side view of a double acting pneumatic cylinder 10 is shown. Particularly, the double acting pneumatic cylinder includes a cylinder tube 12 and a slide or follower (not shown) which moves along an external surface of the cylinder tube 12. Various components may be attached to the follower so that they are moved in a linear direction. The follower is reciprocally moved by either magnetic attraction to magnets provided on a piston housed within the cylinder tube 12 such as a rodless cylinder or by mechanical coupling such as in a rodded cylinder as illustrated. The end cap 16 is shown on the end of the cylinder tube 12 to seal the open ends thereof.

A preferred embodiment of the invention for a cushioning system formed within an end cap 16 is illustrated in FIG. 1. More specifically, the piston 20 is a cylindrical design and slidably moves on the internal surface 14 of the cylinder tube 12. At least one two-way piston seal, e.g., an o-ring seal is placed around the circumference of the piston 20 so that a fluid-tight seal between the piston 20 and cylinder tube 12 is formed. In the case of a double acting cylinder, it is preferable to use two one-way lip seals 21, one on each end of the piston. The piston 20 has attached thereto a piston rod 23. The cylinder tube 12 has an open end 17 which is closed off by the end cap 16. The piston 20 is driven within the cylinder tube 12 when a pneumatic fluid, such as air, is introduced into the cylinder tube 12 via the inlet/exhaust port 18 provided in the end cap.

The present invention is directed to a cushioning device to dampen/cushion the movement of the piston 20 at the end of its stroke, i.e. as the piston approaches either of the two end caps 16. If a cushioning system were not provided, the piston face 22 would contact the end cap face 24 and possibly damage the device. To achieve the cushioning means of the present invention, the piston 20 includes a piston spear 26 extending outwardly from the piston face 22. The piston spear 26 is substantially cylindrical having an outer diameter smaller than the outer diameter of the piston body. The end cap 16 is a provided with a cooperating spear receiving space 28 which is dimensioned to be slightly larger than the piston spear 26. The spear receiving space 28 includes an internal annular seal 31 that contacts the outer surface of the piston spear 26 to form a fluid-tight seal.

The cushioning system of the present invention operates such that as the piston 20 moves towards the end cap 16, a volume chamber 32 of air is created between the piston spear making contact with the end cap seal 31 and the piston body seal 21. The air trapped in the volume chamber 32 is compressed until the piston travel is terminated. More specifically as the piston 20 moves closer to the end cap 16, the volume chamber 32 is decreased, however, the air in the volume chamber 32 is trapped and compressed. A sufficient of amount of air is compressed in the volume chamber 32 so that the piston 20 is brought to a stop before the piston face 22 contacts the end cap face 24. The piston 20 is stopped when the air in the volume chamber 32 can no longer be compressed by the piston 20 that is moving toward the end cap face 24. The advantage to this system is that the piston 20 is not stopped by hitting a hard surface such as the end cap 16 but is instead stopped in a gradual motion by a cushion of air that is formed in the volume chamber 32. Such a method of end position cushioning will inherently produce variable strokes since many factors effect the compressibility of air, e.g., tubing size, tubing length, piston speed and chamber size. However, the advantage of the system is a low decibel or "silent" operation of a double acting cylinder which helps reduce overall system noise. Such an advantage is especially useful in applications where multiple cylinders are being operated simultaneously.

In a more preferred embodiment, the end cap face 24 is provided with at least one bumper ring 34 positioned on the end cap face 24. The bumper ring 34 is preferably made from an elastomeric material, such as polyurethane or neoprene. The bumper ring 34 is positioned on the end cap face 24 and has an aperture therethrough greater than the size of the piston spear 26 to allow unimpeded movement of the piston 20. The purpose of the bumper ring 34 is to provide a secondary means to cushion an end position of the piston 20 in the event that the air cushioning system described above should begin to wear due to extended use or poor environmental conditions, such as bad air quality or extreme heat. The bumper ring 34 permits continued operation of the cylinder until such time that the integrity of the volume chamber 32 can be restored. It may be preferable as shown in FIG. 1 to use more than one bumper ring 34 stacked together for added safety.

Although the illustrative embodiments of the present invention have been described herein with reference to the company drawing, it is to be understood that the invention is not limited to those precise embodiments and that various other changes and modifications may be effect herein by one skilled in the art without departing from the scope or sprit of the invention, an that it is intended to claim all such changes and modification as fall within the scope of the invention.

What is claimed:

1. A pneumatic cylinder comprising:

a cylinder tube having at least one open end;

an end cap coupled to the open end of the cylinder tube; and a piston reciprocally movable within the cylinder tube, wherein the piston includes at least a first seal thereon to create a substantially fluid-tight seal with an internal surface of the cylinder tube, the piston further including a piston spear at an end portion thereof, the end cap further includes a cooperating piston spear receiving space dimensioned to receive the piston spear therein, wherein one of the end cap piston spear receiving space and piston spear includes a second seal for creating a substantially fluid-tight seal therebetween thereby establishing a non-vented volume chamber between the at least first seal and second seal such that air is trapped within the non-vented volume chamber and upon compression provides cushioning at an and of a piston stroke.

2. A pneumatic cylinder as defined in claim 1, further comprising an air inlet/exhaust port provided in said end cap.

3. A pneumatic cylinder as defined in claim 1, wherein the cylinder is a rodded cylinder.

4. A pneumatic cylinder as defined in claim 1, wherein the pneumatic cylinder is a rodless cylinder.

5. A pneumatic cylinder as defined in claim 1, further comprising at least one elastomeric cushioning device positioned on one of an end surface of the end cap and a piston face.

6. A pneumatic cylinder as defined in claim 5, wherein said elastomeric cushioning device is an annular ring.

7. A pneumatic cylinder as defined in claim 6 wherein the elastomeric cushioning device is made from one of polyurethane and neoprene.

8. A pneumatic cylinder as defined in claim 1, wherein the first seal is a two-way seal.

9. A pneumatic cylinder as defined in claim 1, wherein the first seal comprises two one-way seals, one at each end of said piston to form a fluid-tight seal between the piston and the cylinder tube.

10. A pneumatic cylinder as defined in claim 5, wherein a plurality of elastomeric cushioning devices are provided.

11. A cushioning system of a pneumatic cylinder comprising:

a cylinder tube;

an end cap sealingly coupled to an end of said cylinder tube; and a piston reciprocally movable within the cylinder tube by means of pneumatic fluid, said piston including a piston seal for creating a fluid-tight seal between the piston and cylinder tube and a means for creating a fluid-tight seal between the piston and the end cap, wherein pneumatic fluid is trapped between the piston seal and the seals between the piston and the end cap forming a non-vented volume chamber, whereby upon compression of the fluid in the non-vented volume chamber, movement of the piston is dampened and the piston is prevented from contacting the end cap.

12. The cushioning system as defined in claim 11, wherein the means for creating a fluid-tight seal between the piston and the end cap comprises the piston having a piston spear and the end cap having a piston spear receiving space, one of the piston spear and end cap piston spear receiving space including a seal member for providing a fluid-tight seal therebetween.

13. The cushioning system as defined in claim 11, further comprising a bumper provided on an end surface of the end cap.

* * * * *